US010912356B1

(12) United States Patent
Verret

(10) Patent No.: US 10,912,356 B1
(45) Date of Patent: Feb. 9, 2021

(54) HANDS FREE UMBRELLA APPARATUS

(71) Applicant: Preston Verret, Houma, LA (US)

(72) Inventor: Preston Verret, Houma, LA (US)

( * ) Notice: Subject to any disclaimer, the term of this patent is extended or adjusted under 35 U.S.C. 154(b) by 0 days.

(21) Appl. No.: 16/720,239

(22) Filed: Dec. 19, 2019

(51) Int. Cl.
*A45B 11/02* (2006.01)
*A45C 13/40* (2006.01)

(52) U.S. Cl.
CPC ..... *A45B 11/02* (2013.01); *A45C 13/40* (2013.01)

(58) Field of Classification Search
CPC ..... A45B 11/02; A45C 13/40
See application file for complete search history.

(56) References Cited

U.S. PATENT DOCUMENTS 225,409 A * 3/1880 Mora ..... A45B 11/02 224/190
1,041,577 A * 10/1912 Bekkevar ..... A45B 11/02 224/190
1,205,917 A * 11/1916 Merrill ..... A45B 11/02 224/190
1,262,402 A * 4/1918 Stuckey ..... A45B 11/02 224/190
1,347,540 A * 7/1920 Godard ..... A45B 11/02 224/190
1,704,407 A * 3/1929 Rice ..... A45B 11/02 224/190
5,263,837 A * 11/1993 Dompe ..... A45B 11/02 224/190
6,024,464 A 2/2000 De Vera
8,678,019 B2 3/2014 Christie
9,538,832 B2 * 1/2017 Chou ..... A45B 11/02
9,993,052 B2 * 6/2018 Williams ..... A45B 11/02
2013/0313295 A1 * 11/2013 Jacquette ..... A45B 11/02 224/190

* cited by examiner

*Primary Examiner* — Noah Chandler Hawk
(74) *Attorney, Agent, or Firm* — Sanchelima & Associates, P.A.; Christian Sanchelima; Jesus Sanchelima

(57) ABSTRACT

A hands-free umbrella holder is disclosed herein. The hands-free umbrella holder includes a back covering having adjustable shoulder straps, shoulder covering, and an umbrella holding sleeve on the back covering. The umbrella holder includes a vest assembly having a shoulder portion extending substantially along a user's shoulders and towards their stomach area. The vest includes side openings providing the user ample room to move their arms. Additionally, the vest includes a back portion having a holding assembly mounted thereon. The holder assembly is a tube member that is attached to the vest through means of brackets and screws. An umbrella is then placed within the tube providing the user with shielding form the sun and other weather conditions while having full use of their hands.

7 Claims, 5 Drawing Sheets

HANDS FREE UMBRELLA APPARATUS

II. BACKGROUND OF THE INVENTION

1. Field of the Invention

The present invention relates to a hands-free umbrella apparatus and, more particularly, to a hands free umbrella apparatus that includes a vest assembly mounted onto a user and a holding assembly configured to hold an umbrella and mounted onto the vest.

2. Description of the Related Art

Several designs for an umbrella holder have been designed in the past. None of them, however, include a hands-free umbrella holder including a back covering having adjustable shoulder straps, shoulder covering, and an umbrella holding sleeve on the back covering. The umbrella holder includes a vest assembly having a shoulder portion extending substantially along a user's shoulders and towards their stomach area. The vest includes side openings providing the user ample room to move their arms. Additionally, the vest includes a back portion having a holding assembly mounted thereon. The holder assembly is a tube member that is attached to the vest through means of brackets and screws. An umbrella is then placed within the tube providing the user with shielding form the sun and other weather conditions while having full use of their hands. It is known that during harsh weather conditions, an individual may use an umbrella to protect themselves against extreme sun, rain, and snow. It is also known, when an individual is operating a traditional umbrella to shield themselves from these conditions, they need to use one of their hands to operate the umbrella. As a result, a user has less mobility to carry their bags or operate the equipment needed in an outdoor area. Therefore, there is a need for a hands-free umbrella holder that attaches to a user's shoulders that holds the umbrella for the user. The user is able to maintain full mobility of his hands while protecting themselves from harsh weather conditions.

Applicant believes that a related reference corresponds to U.S. Pat. No. 8,678,019 issued for an umbrella engaged with a backpack. Applicant believes another related reference corresponds to U.S. Pat. No. 6,024,464 issued for an umbrella support harness. However, these references differ from the present invention because they fail to disclose a hands-free umbrella holder including a back covering having adjustable shoulder straps, shoulder covering, and an umbrella holding sleeve on the back covering. The present invention addresses these issues by providing a vest assembly configured to be attached to a user and a holder assembly attached to the vest assembly. The holder assembly holds an umbrella for a user while providing them full mobility to their hands.

Other documents describing the closest subject matter provide for a number of more or less complicated features that fail to solve the problem in an efficient and economical way. None of these patents suggest the novel features of the present invention.

III. SUMMARY OF THE INVENTION

It is one of the objects of the present invention to provide an umbrella holder that provides protection to a user from harsh weather conditions while simultaneously providing full mobility of their hands.

It is another object of this invention to provide an umbrella holder having an adjustable vest assembly that is configured to fit a variety of users. The vest assembly includes a belt strap that allows a user to properly adjust the vest to their waist It is still another object of the present invention to provide an umbrella holder having a holder assembly with an umbrella mounted therein. The holder assembly includes elastic straps, allowing the user to securely attach the umbrella to the holder and prevents the umbrella from being blown away due to harsh weather conditions.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 1 represents an operational view of umbrella holder 10 in accordance to an embodiment of the present invention.

FIG. 2 shows an isometric view of umbrella holder 10 having vest assembly 20 and holder assembly 40 in accordance to an embodiment of the present invention.

Figure 1:
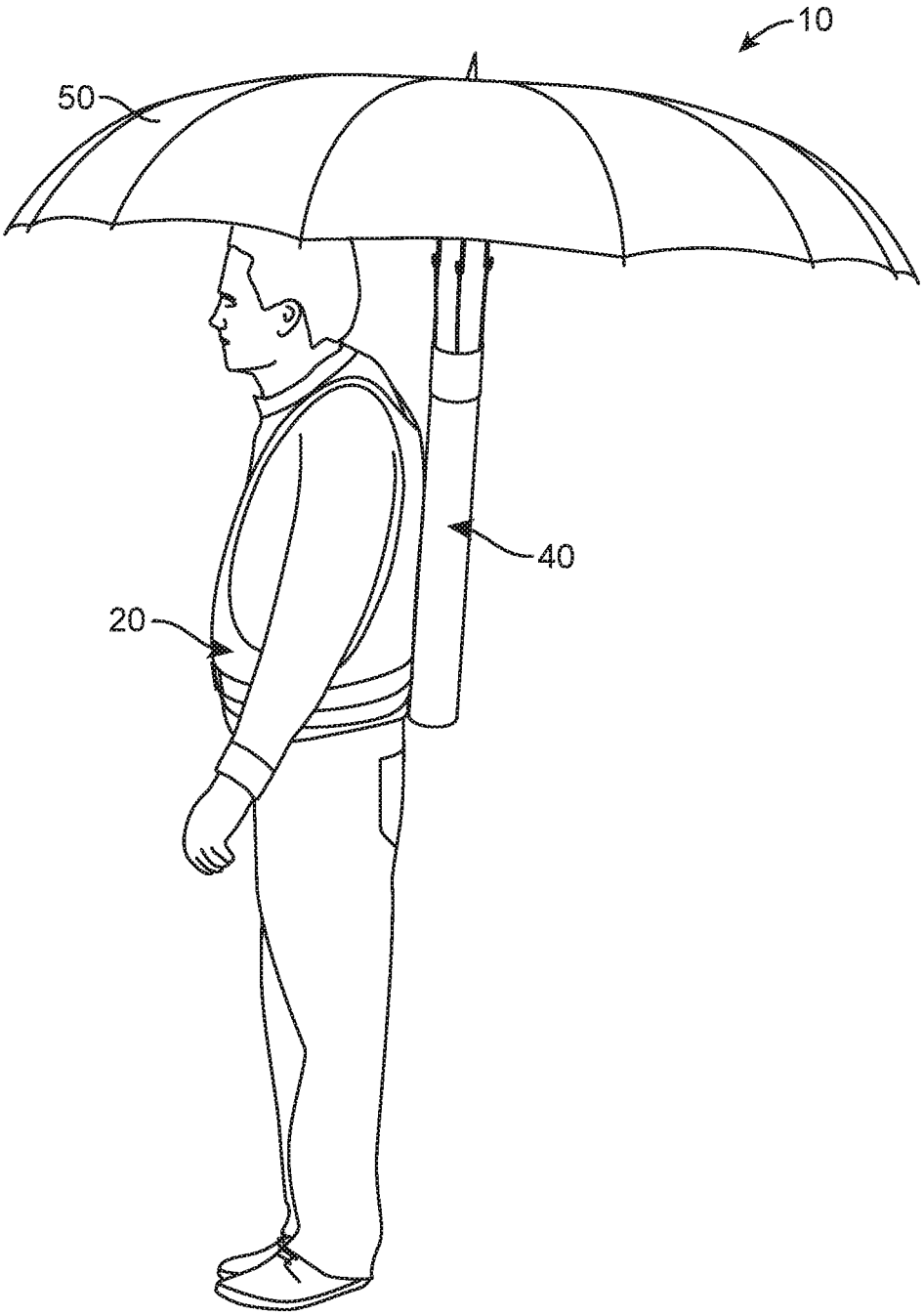
Figure 2:
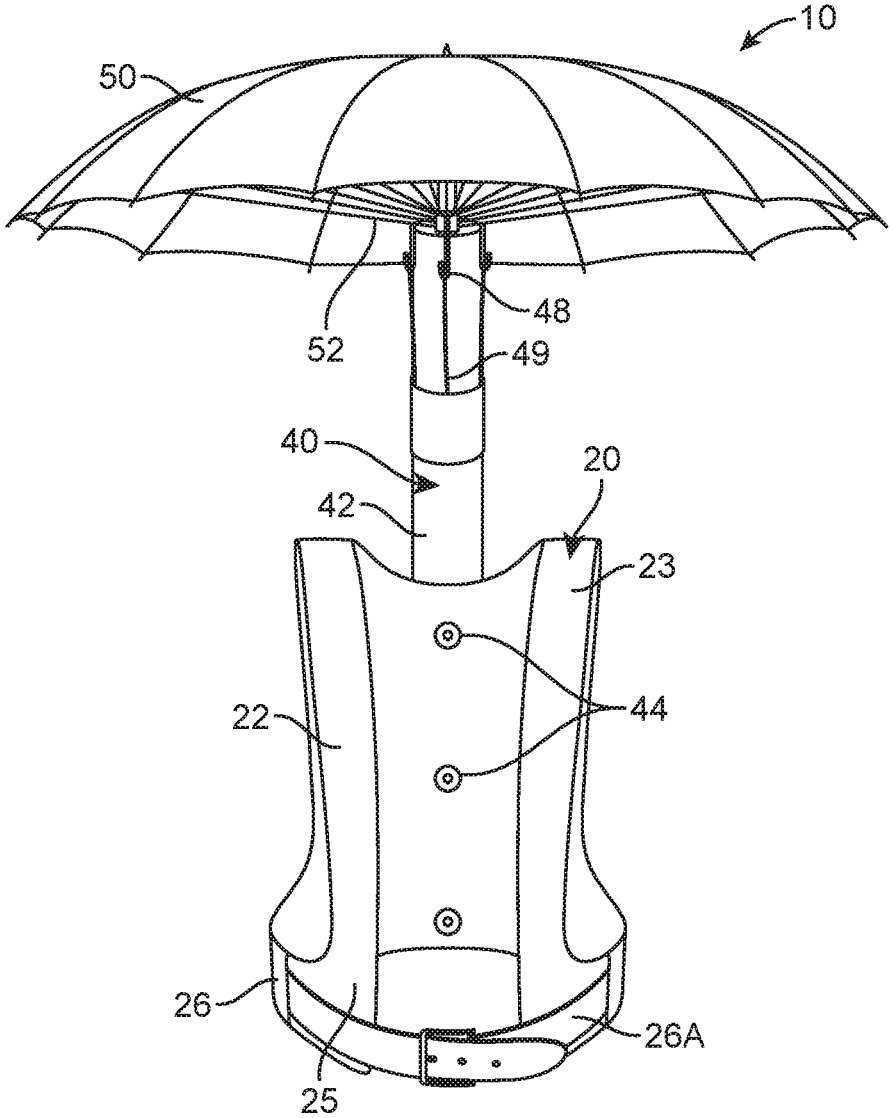
Figure 3:
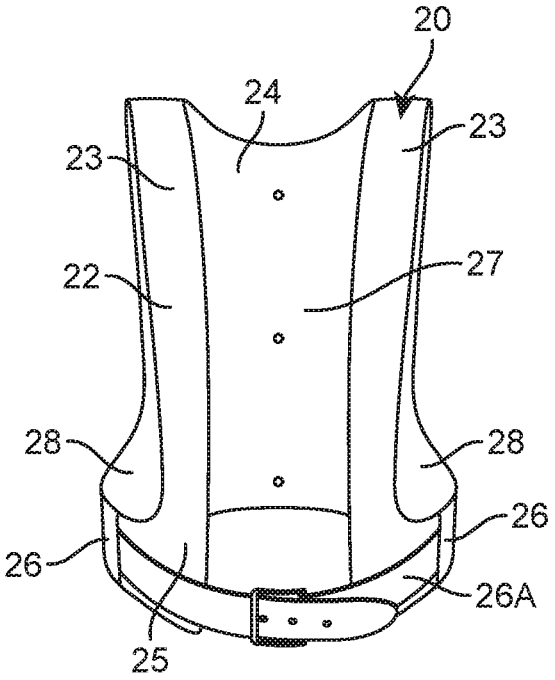
FIG. 3 illustrates an isometric view of vest assembly 20 in accordance to an embodiment of the present invention.
Figure 4:
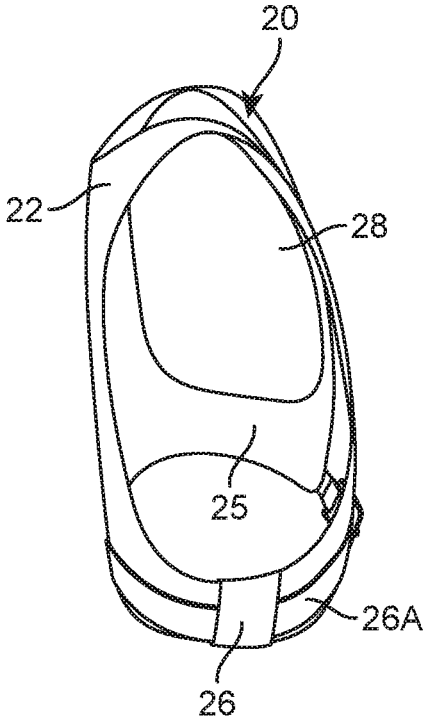
FIG. 4 is a representation of an isometric side view of vest assembly 20 in accordance to an embodiment of the present embodiment.
Figure 5:
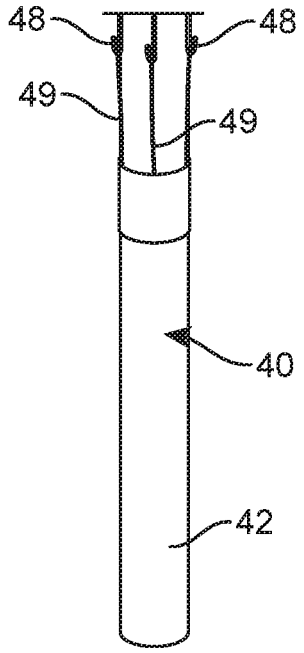
FIG. 5 shows an isometric view of holder assembly 40 in accordance to an embodiment of the present invention.
Figure 6:
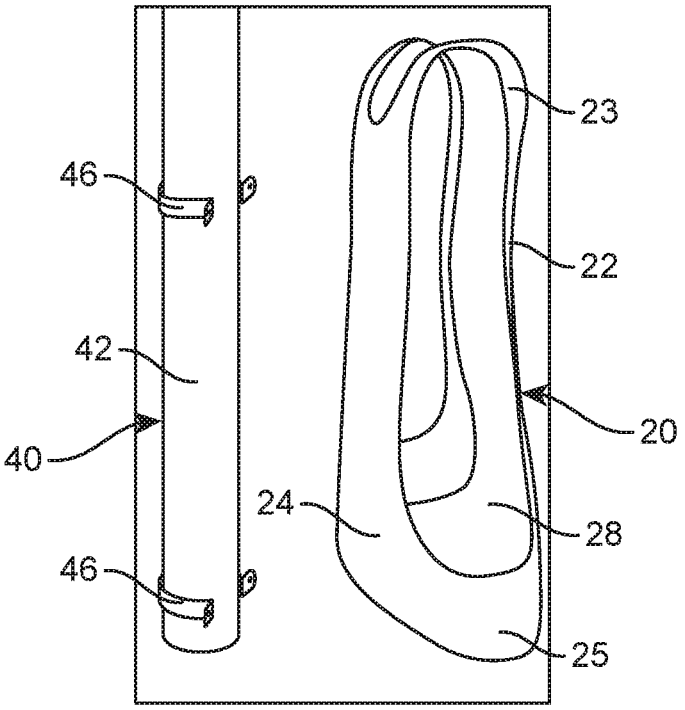

FIG. 6 illustrates a side view holder assembly 40 being attached to vest assembly 20 through mounting members 46 in accordance to an embodiment of the present invention.

Figure 7:
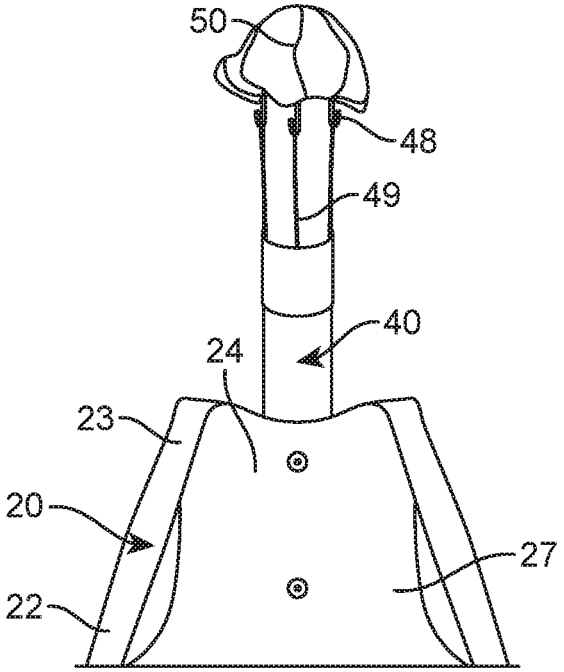

FIG. 7 represents an isometric view of umbrella holder 10 having umbrella 50 in a closed position within holder assembly 40.

V. DETAILED DESCRIPTION OF THE EMBODIMENTS OF THE INVENTION

Referring now to the drawings, where the present invention is generally referred to with numeral 10, it can be observed an umbrella holder 10 having a vest assembly 20 and a holder assembly 40.

Vest assembly 20 includes a vest 22 having shoulder straps 23 adapted to be worn by a user. In one embodiment, vest 22 is an open vest that partially covers a user's shoulders through shoulder straps 23. Additionally, vest 22 may be made of a suitable sturdy material. This material may include materials such as but not limited to reinforced cloth, PVC frames, and the like. Additionally vest 22 further includes a back portion 24. Back portion 24 represents a back end of vest 22 that remains in contact with the user's back. Additionally, back portion 24 may have a substantially rectangular shape and entirely covers the back of a user. Shoulder straps 23 may extend from the top of each corner of back portion 24. Further, shoulder straps 23 may extend vertically along the chest of and stomach area of a user. Additionally, straps 23 may also be fairly thin straps such that they do not cover the entire front area of a user. As a result, the weight of vest 22 is lessened on the user thereby providing a lighter and more comfortable vest 22.

Vest 22 further includes a waist portion 25. In one embodiment, waist portion 25 extends from bottom sides of back portion 24 and extend along the waist of a user to then be communicably attached to shoulder straps 23. Waist portion 25 further includes slots 26 mounted thereon. In one embodiment, slots 26 is a vertically mounted rectangular member extending the entire length of waist portion 25. The rectangular member is mounted in such a way that it includes an opening thereby forming slots 26. In one embodiment, a user inserts a belt 26A through slots 26. Belt 26A then extends the entire length of back portion 24 and waist portion 25. Belt 26A may be a generic rectangular leather belt in one embodiment. Belt 26A aids the user in securing and adjusting vest 22 onto their body.

In one embodiment, vest 22 is an open vest. As a result, a center opening 27 is formed between the chest and stomach area of the user when the vest is worn. This allows vest 22 to be easily equipped by a user by inserting their body through the center opening 27 of vest 22. Center opening 27 may be a vertical opening that separates shoulder straps 23. Additionally, vest 22 includes side openings 28 located on each side of vest 22. In one embodiment, side openings 28 are oval in shape and extend up to a waist region of a user. Additionally, side openings are formed by the open area encompassing side ends of back portion 24, waist portion 25, and shoulder straps 23. Furthermore, side openings 28 are substantially large openings allowing a user to have full mobility of their arms when vest 22 is equipped.

Holder assembly 40 includes a sleeve 42. In one embodiment, sleeve 42 is a uniform hollow cylindrical tube having a top opening and a closed bottom end. Additionally, sleeve 42 receives umbrella 50 in an open configuration therein. It should be understood other shapes and embodiments of sleeve 42 may be included. Sleeve 42 is then mounted onto a center portion of back portion 24 of vest 22. In one embodiment, sleeve 42 is mounted in such a way that a bottom end of sleeve 42 remains flush with a bottom end of back portion 24. Additionally, sleeve 42 may be mounted in such a way that a top end of sleeve 42 extends beyond a top end of back portion 24. It should be understood, other mounting locations of sleeve 42 may be applicable to holder assembly 40.

In one embodiment, sleeve 42 is mounted onto back portion 24 using fastening members 44. Fastening members 44 may be generic screws as known in the art of mounting. Additionally, fastening members 44 may be positioned vertically along the center portion of pack portion 24. Fastening members 44 then communicably connect sleeve 42 to back portion 24. Sleeve 42 may also be secured to back portion 24 using mounting members 46. In one embodiment, mounting members 46 may be metal U-shaped brackets that are attached to a rear side of back portion 24 and lock sleeve 42 in place. It should be understood, any combination of fastening members 44 and mounting member 46 may be used to secure sleeve 42 to back portion 24.

Holder assembly 40 further includes loop members 48 mounted near a top end of sleeve 48. In one embodiment, loop members 48 are circular rings located near top end of sleeve 48 and integrally mounted thereon. Loop members 48 may include but are not limited to, cloth loops, metal rings, and the like. Additionally, holder assembly includes elastic cords 49 mounted thereon. Elastic cords 49 may be cords such as bungie cords or any other suitable elastic member. Furthermore, elastic cords 49 may be integrally mounted to sleeve 42 at a location beneath loop members 48. In one embodiment, elastic cords 49 are mounted in a vertical portion along the top portion of sleeve 42. Elastic cords 49 may be provided for each of loop members 48 respectively. Elastic cords 49 may be mounted parallel to each other along the top portion of sleeve 42. Further, Elastic cords 49 may be hooked onto loop members 48 to form a resting position. In one embodiment, elastic cords 49 may then be detached from loop members 48 to then be mounted onto spokes 52 of umbrella 50 in an open position. As a result, a secure attachment is created for umbrella 50 and sleeve 42. This prevents umbrella 50 from being blown away during harsh weather conditions.

In one embodiment, a user equips vest assembly 20 having holder assembly 40 mounted thereon. Umbrella 50 is then inserted within sleeve 42 in an open position. Elastic cords 49 are then removed from loop members 48 and attached to spokes 52 of umbrella 50. As a result, umbrella 50 provides protection to a user from extreme sunlight and rain. Additionally, the user maintains full use of his arms while being protected from the harsh weather conditions. In one embodiment, umbrella 50 may be stored within sleeve 42 in a closed position. In this embodiment, umbrella 50 may be entirely within sleeve 42 or partially protruding outwardly. Umbrella holder 10 provides the best protection to a user from harsh weather conditions.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for an umbrella holder, comprising:

a. a vest assembly including a vest having shoulder straps, said vest further including a back portion having a substantially rectangular shape, wherein said shoulder straps extend from each corner of a top end of said back portion, wherein said shoulder straps are adapted to extend vertically along the chest and stomach of a user, wherein said vest further includes a waist portion extending from sides of a bottom end of said back portion and configured to extend along the waist of a user, said waist portion including slots on said waist portion, said vest including a center opening and two side openings; and b. a holder assembly including a sleeve being a uniform cylindrical tube, wherein said tube receives an umbrella in an open configuration therein, wherein said sleeve is mounted to a center portion of said back portion of said vest, wherein a bottom end of said sleeve remains flush with a bottom end of said back portion, wherein said sleeve extends beyond said top end of said back portion, wherein an upper end of said sleeve includes loop members having elastic cords attached thereon, wherein said elastic cords are mounted in a vertical position along said upper end of said sleeve, wherein said elastic cords are detached from said loop members and attached to spokes of said umbrella in said open configuration.

2. The system for an umbrella holder of claim 1 wherein said sleeve is mounted to said back portion through fastening members.

3. The system for an umbrella holder of claim 2 wherein said fastening members are positioned vertically along said center portion of said back portion.

4. The system for an umbrella holder of claim 1 wherein said sleeve is mounted to said back portion through mounting members, said mounting members being metal brackets attached to a rear side of said back portion.

5. The system for an umbrella holder of claim 1 wherein said umbrella is stored in a closed configuration within said sleeve.

6. The system for an umbrella holder of claim 1 wherein said slots receive a belt therethrough adapted to secure said vest to a user's upper body.

7. A system for an umbrella holder, comprising a. an umbrella having spokes, b. a vest assembly, including a vest having shoulder straps, said vest further including a back portion having a substantially rectangular shape, wherein said shoulder straps extend from each corner of a top end of said back portion, wherein said shoulder straps are adapted to extend vertically along the chest and stomach of a user, wherein said vest further includes a waist portion extending from sides of a bottom end of said back portion and configured to extend along the waist of a user, said waist portion including slots on said waist portion, wherein said slots receive a belt therethrough adapted to secure said vest to a user's upper body, said vest including a center opening and two side openings; and c. a holder assembly including a sleeve being a uniform cylindrical tube, wherein said tube receives said umbrella in an open configuration therein, wherein said sleeve is mounted to a center portion of said back portion of said vest, said sleeve is mounted to said back portion through mounting members, said mounting members being metal brackets attached to a rear side of said back portion, wherein a bottom end of said sleeve remains flush with a bottom end of said back portion, wherein said sleeve extends beyond said top end of said back portion, wherein an upper end of said sleeve includes loop members having elastic cords attached thereon, wherein said elastic cords are mounted in a vertical position along said upper end of said sleeve, said elastic cords are detached from said loop members and attached to said spokes of said umbrella when said umbrella is in said open configuration.

* * * * *